United States Patent [19]

Adams, Jr.

[11] 4,403,657

[45] Sep. 13, 1983

[54] LOCKING MANDREL HAVING DOGS FOR LATCHING TO A LANDING NIPPLE AND LUGS FOR LATCHING TO AN OPERATOR RECIPROCAL IN THE LANDING NIPPLE

[75] Inventor: James B. Adams, Jr., Lewisville, Tex.

[73] Assignee: Otis Engineering Corporation, Dallas, Tex.

[21] Appl. No.: 222,773

[22] Filed: Jan. 6, 1981

[51] Int. Cl.[3] ..... E21B 34/14

[52] U.S. Cl. ..... 166/322; 166/386

[58] Field of Search ..... 166/322, 386, 153–156, 166/72, 373, 374, 375

[56] References Cited

U.S. PATENT DOCUMENTS

| | | | |
|---|---|---|---|
| 3,744,564 | 7/1973 | Moh | 166/72 |
| 3,763,937 | 10/1973 | Dinning | 166/72 |
| 4,044,835 | 8/1977 | Moh | 166/322 |
| 4,071,088 | 1/1978 | Moh | 166/386 |
| 4,256,180 | 3/1981 | Moh | 166/72 |
| 4,294,315 | 10/1981 | Yonkers et al. | 166/154 |

*Primary Examiner*—William F. Pate, III

*Attorney, Agent, or Firm*—Vinson & Elkins

[57] ABSTRACT

A valve for landing in a landing nipple which landing nipple includes an actuator for the valve with the valve including radially expansible locking means for locking the valve to the landing nipple and to the actua

8 Claims, 10 Drawing Figures

LOCKING MANDREL HAVING DOGS FOR LATCHING TO A LANDING NIPPLE AND LUGS FOR LATCHING TO AN OPERATOR RECIPROCAL IN THE LANDING NIPPLE

This invention relates to locking mandrels for locking equipment in landing nipples and more particularly to a valve which may be locked in a landing nipple and have its actuator locked to an operator in the landing nipple.

In my copending application Ser. No. 156,200, filed June 3, 1980, there is shown a valve having provisions for a secondary valve. The disclosure of this application is incorporated herein by reference in its entirety.

This invention provides an improved locking mandrel assembly which may include a secondary valve and be utilized as a secondary valve in the above identified application.

In the U.S. patent to Mott, No. 3,744,564, a secondary valve is disclosed. The Mott structure has the disadvantage that to retrieve the secondary valve the secondary valve actuator must be operable to move the secondary valve to open position. Thus, if for some reason the Mott actuator cannot be shifted to valve opening position, the lower latch assembly between the secondary valve and the actuator cannot be released and the valve cannot be removed utilizing normal pumpdown procedures.

It is an object of this invention to provide a secondary valve which may be removed utilizing normal pumpdown procedures, even though the operator for shifting the valve actuator between open and closed positions be inoperative.

Another object is to provide a secondary valve in which all prop-out and expander structures are accessible from above the valve member so that the prop-outs and expanders can be released and the secondary valve recovered utilizing wireline techniques if pumpdown techiques are incapable of retrieving the secondary valve.

Another object is to provide a secondary valve which has all of its expander and prop-out apparatus accessible from the upper end of the valve and in which the valve member may be pumped open by tubing pressure so that the secondary valve may be recovered by pumpdown procedures and/or wireline procedures in the event the normal control system is inperative to move the secondary valve to open position.

Another object is to provide a removable secondary subsurface safety valve in which reciprocation of a lug expander on top of the valve results in locking of the valve and its actuator in a landing nipple and landing nipple operator and thereafter further reciprocation of the lug expander relative to the actuator for the valve releases the valve and the actuator from the landing nipple and operator to permit it to be readily removed from the landing nipple.

Another object is to provide a locking mandrel in which reciprocation of a lug expander on top of the locking mandrel secures the locking mandrel at two spaced points in a landing nipple and in which subsequent reciprocation of the lug expander releases the locking mandrel for removal from the landing nipple.

Another object is to provide a removable subsurface safety valve for latching to a landing nipple and a landing nipple operator in which the latching controls are accessible from above even with the valve closed so that under any circumstances the controls are available for releasing the valve.

Another object is to provide a secondary subsurface safety valve for pumping into a well in which the valve has the same length during running and retrieving to utilize the maximum permissible length consistent with standard pumpdown tubing bend radiuses.

Another object is to provide a removable secondary subsurface safety valve for landing in a landing nipple which includes a reciprocal operator for the valve in which tubing pressure is effective to open the valve permitting it to be propped open to facilitate pumping the valve up the tubing after it has been released from the nipple and operator.

Another object is to provide a single reciprocal member engageable by running and pulling tools which on reciprocation will lock the valve in a landing nipple and lock the valve actuator to an operator in the landing nipple and which upon further reciprocation of the single part by a pulling tool will release the subsurface safety valve from the nipple and operator.

Other objects, features and advantages of this invention will be apparent from the drawings, the specification and the claims.

In the drawings wherein an illustrative embodiment of this invention is shown,

Figures 3, 4, 5, 6, 7, 8, 9:
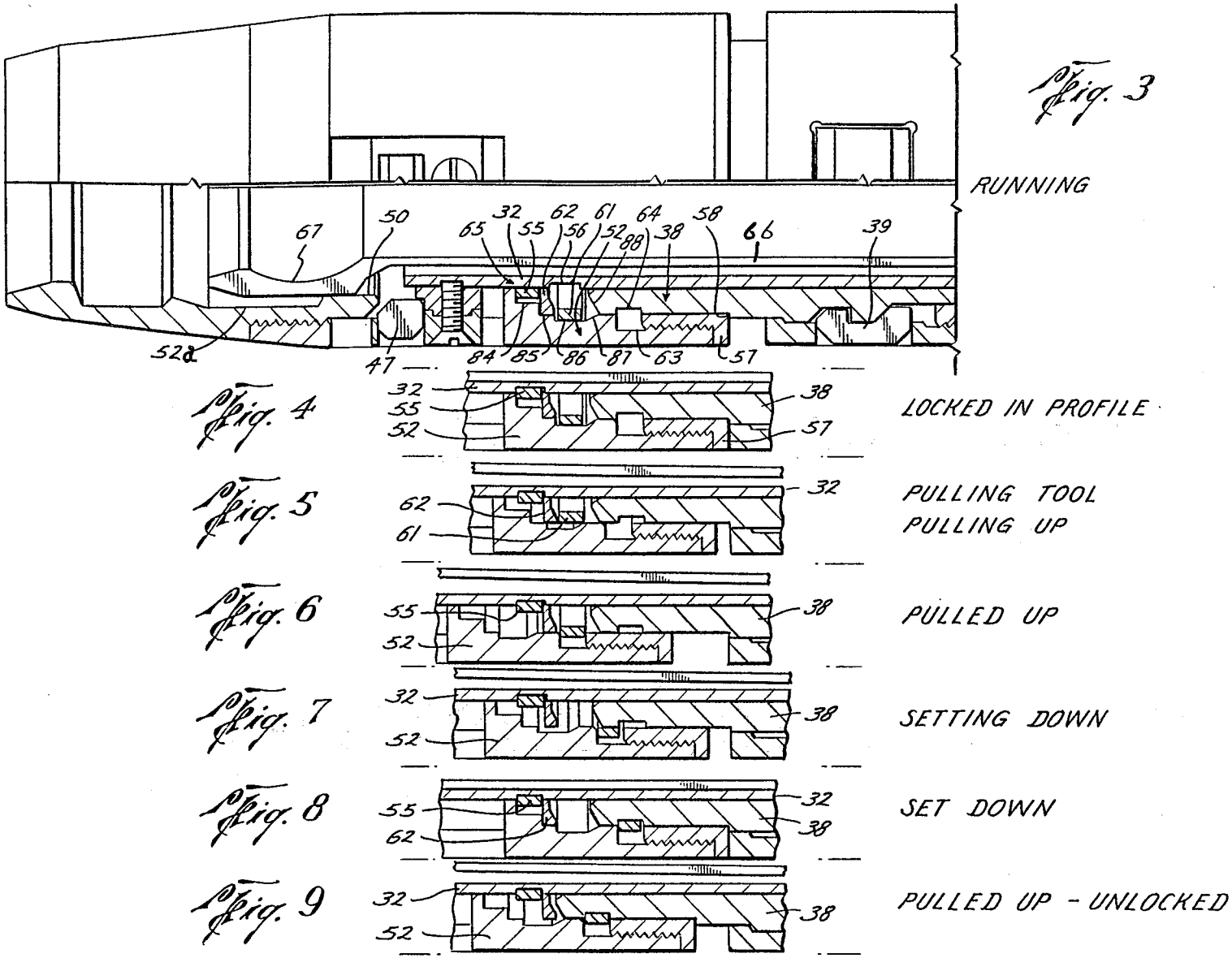
FIG. 3 is a fragmentary quarter-section view of the secondary valve while being run.

FIGS. 4–9 are fragmentary sectional views of the system for locking the secondary valve in the landing nipple and showing successively the system locked in the profile for normal operation, in FIG. 5 the lug expander being pulled up by a pulling tool, in FIG. 6 the lug expander in fully pulled up position by a pulling tool, in FIG. 7 setting down of the lug expander by a fishing tool, FIG. 8 the full set down position in which the lug expander and dog prop-out have been latched together, and in FIG. 9 the pulled up and unlocked position for removal of the valve.

Figure 1A:
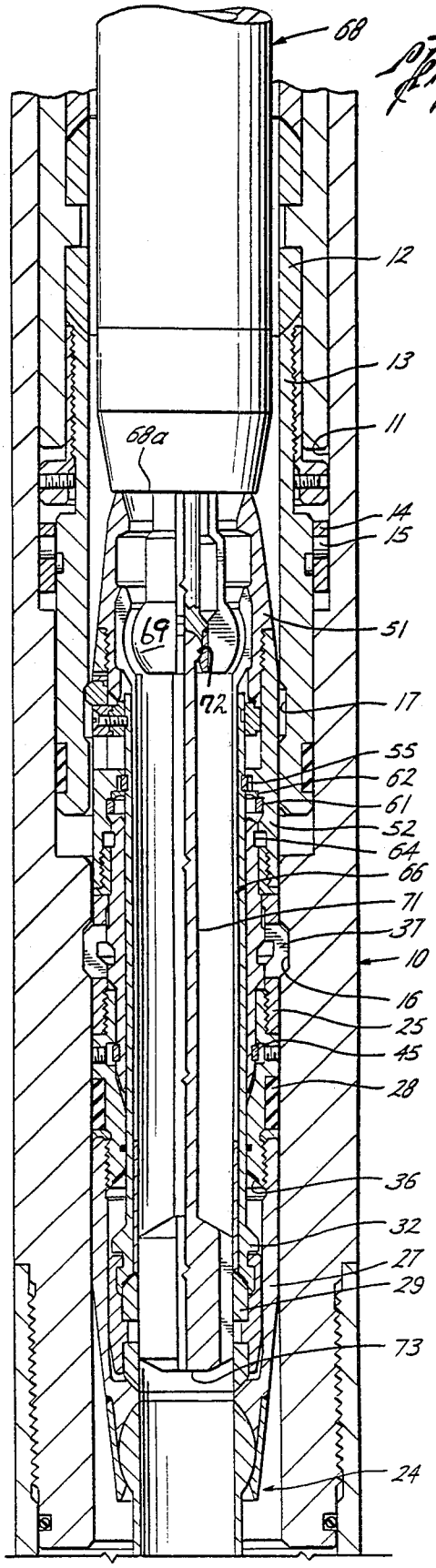
FIGS. 1A and 1B are continuation views showing in cross-section a locating mandrel and a landing nipple with a subsurface safety valve constructed in accordance with this invention landed therein and showing partly in elevation and partly in quarter-section the running tool for running the valve into the hole.

Referring first to FIG. 1A the landing nipple indicated generally at 10 is provided by a continuation of the main valve body of the primary valve structure. The nipple 10 includes a bore 11 in which the main valve 12 is positioned. The valve 12 is shown in open position and is operated by reciprocation of the valve operator 13. In accordance with this invention the main valve 12 will be locked in open position and will reciprocate vertically within the landing nipple 10 with reciprocation of operator 13. As shown in the above indentified application, this operator is preferably one in which reciprocating force in both directions is applied through a resilient member, such as a spring.

The stop 14 normally limits reciprocation of the operator 13 during normal operation of the main valve 12. As shown, the shear pin 15 has been sheared to permit the operator to move to a position locking the main valve 12 in open position as taught in the above identified application.

The landing nipple 10 is provided with a locking groove 16 for locking a locking mandrel in position in the nipple.

In like manner, the operator 13 is provided with a locking groove 17 for locking an actuator of a structure such as the valve illustrated to the operator 13.

Figure 1B:
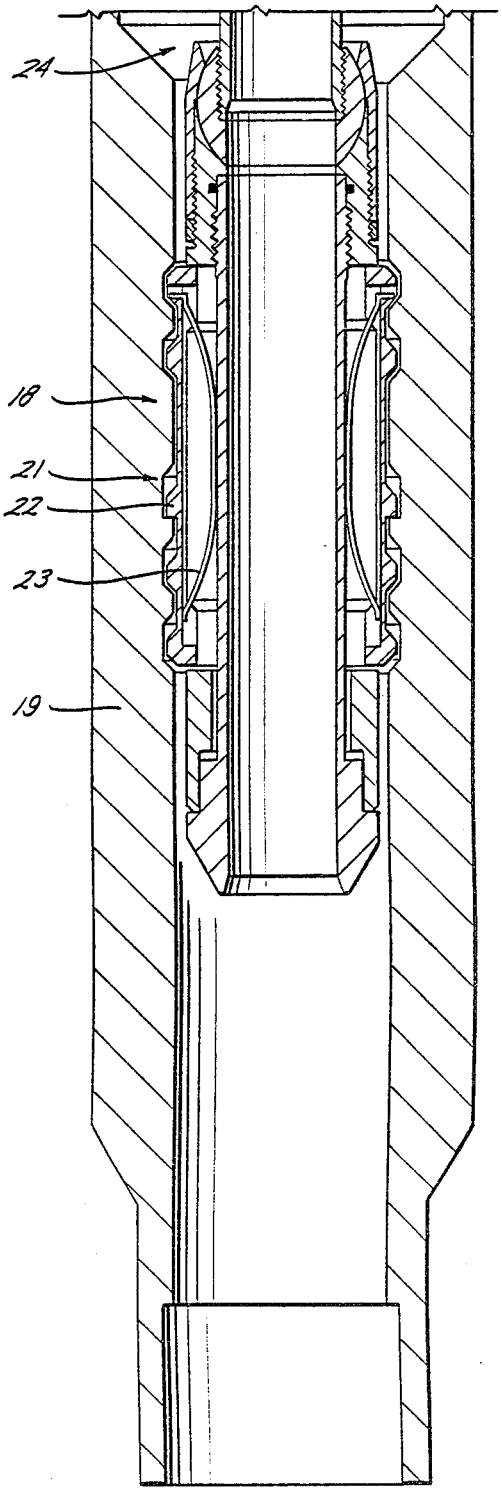

As is conventional with well tools, it is desired to be able to positively locate the tool relative to a particular landing nipple such as nipple 10. Positive location is provided by a select key locator indicated generally at 18 in FIG. 1B landed in the locating nipple 19. The nipple 19 is provided with a key profile indicated generally at 21 which receives the several keys 22 on the locating mandrel. These keys are urged outwardly by the reilient springs 23 and as the locating mandrel moves down the hole the keys will seek to find any profile having grooves which mate with the exterior profile of the keys. Thus, by varying the profile of the keys and the profile of the locating nipple, the operator may be assured that equipment will land only in the particular locating nipple selected.

While the equipment illustrated may be run on wireline, it is illustrated in the pumpdown form and for this purpose the locating mandrel has at its upper end a double articulating joint indicated generally at 24 which permits the locating nipple to articulate relative to the tool on which it is carried and traverse the normal pumpdown loop having a radius no greater than five feet.

The valve illustrated has a body made up of upper section 25, intermediate section 26 and lower section 27. The lower end of the lower section 27 provides a part of the articulating mechanism indicated generally at 24. Confined between the body sections 26 and 27 is seal means 28 for sealing between the body and the landing nipple 10.

The body is provided with a valve member 29 cooperating with a valve seat 31 to control flow through the subsurface safety valve. While not shown pins are provided in the conventional manner between the lower body section 27 and the valve member 29 to cause the valve member to rotate between the closed position shown in FIG. 2 and the open position shown in FIG. 1 with axial reciprocation of the valve member 29.

A valve actuator 32 is reciprocal in the body and with reciprocation effects reciprocation and consequent rotation of the valve member 29. The valve actuator 32 carries a pair of arms **33*a* and 33*b* which have pins journalled in holes 34*a* and 34*b* in the valve member 29 to effect reciprocation of the valve member 29 with the actuator 32** and rotation thereof between open and closed positions in the conventional manner.

The valve actuator is provided with an external annular seal surface 35 which cooperates with a confronting internal annular seat 36 on the intermediate body section 26. As this body section also carries the seal means closing of the valve member 29 and engagement of the seat 36 effectively controls flow through the subsurface safety valve.

A plurality of locking dogs 37 are carried by the upper body section 25 for locking the body in the landing nipple 10.

A dog prop-out 38 is carried by the body for proping the dogs 37 in their extended position to latch the body in the landing nipple. The dog prop-out 38 on its external surface has a land 39 and a groove 41 above the land together with a reduced diameter section 42 below the land. The dogs have an internal groove 43 which receive the land 39 with the portion of the dogs above and below the groove fitting into the prop-out groove 41 and the reduced diameter portion 42.

Thus with the dog prop-out moved upwardly from the position shown in FIG. 1A, the dogs 37 can retract. With the prop-out in the position shown in FIG. 1A the dogs are propped-out and held in extended position by the land 39 and a second land 44 on the prop-out immediately above the groove 41.

The dog prop-out is held in lower or prop-out position by a detent 45 carried in a groove 46 in the intermediate body section 26. The detent cooperates with the groove 46 in the dog prop-out 38 to releasably hold the dog prop-out in the lower position as illustated in FIG. 1A.

Lug means are carried by the actuator 32 for releasably latching the actuator to the operator 13 in the landing nipple 10. In the illustrative embodiment a plurality of lugs 47 are provided in lug carrier 48 which is secured to the actuator 32 in any desired manner, as by studs 49.

A lug expander is provided for expanding said lugs and holding them in expanded position. In the preferred form the lug expander is provided by a two piece sleeve-like member having an upper section 51 and a lower section 52. The lower end of the upper section terminates in a chamferred face 53 which can engage the lugs 47 and expand them to position to engage in the groove 17 in the operator 13.

The upper section 51 of the lug expander has an internal groove 52, an internal land 50, and a pulling shoulder 54 for purposes that will appear hereinafter.

The lower section 52 of the lug expander is provided with slots 54 for receiving the lug carrier 48 to permit reciprocation of the lug expander relative to the actuator 32 and the lug carrier 48.

Detent-lach means are provided for releasably securing the lug expander to the actuator in lug expanded position for reciprocation as a unit. This action is in response to movement of the lug expander to lug expanding position.

In the preferred form the lower section 52 of the lug expander carries detent 55 which while the tool is being run in the hole is expanded and rides on the exterior surface of the valve actuator 32 in a position above that shown in FIG. 1A. As will appear more fully hereinafter in the explanation of operation, as the lug expander makes its initial downward movement to expand lugs 47 it reaches the position shown in FIG. 1A and the detent 55 contracts into the actuator groove 56 to latch the lug expander and actuator together so that they move as a unit during reciprocation of the actuator to open and close the valve. Also at this time collet fingers snap into groove **52*a* and release the running tool as illustrated in FIG. 1A. These fingers also function as a detent in the preferred structure to latch the lug expander in its down or lug expanding position. This permits reciprocation of the valve actuator 32 by the operator 13 while at the same time maintaining the lugs 47 in their expanded position as illustrated in FIG. 1A**.

The detent latch means, after it has latched the lug expander to the actuator, also provides for releasing the lug expander from the actuator and latching the lug expander to the dog prop-out in response to relative reciprocation of the lug expander and the actuator. Thus, when the lug expander is reciprocated relative to the actuator to release same it also engages the dog prop-out so that when the lug expander is finally pulled from under the lugs it also pulls the dog prop-out from under the dogs, thus permitting complete release of the tool by reciprocation of the lug expander which is on top of the tool. This permits retrieval of the valve under any condition as only reciprocation of a part on top of the tool is necessary to release the entire tool from the landing nipple and from the landing nipple operator.

It is also preferred that reciprocation of the lug expander is effective to move the dog prop-out to the dog prop-out position.

Referring first to the latter function it will be noted that the lower section 52 of the lug expander has an adjustable nut 57 on its lower end. This nut is designed to have its lower surface engage the upwardly facing surface 58 provided by a shoulder on the dog prop-out. To provide this shoulder the upper end of the dog prop-out has a slightly reduced diameter section 59 on its upper exterior surface. The lug expander nut 57 has a telescoping relationship with this reduced diameter section 59 of the dog prop-out to permit the lug expander to reciprocate relative to the dog expander and in its initial downward movement to engage the shoulder 58 and move the dog prop-out to the position shown in FIG. 2. Thereafter, the lug expander may reciprocate while the dog expander remains in place and is releasably held in place by the detent 45.

To provide for attachment of the lug expander to the dog prop-out, the detent latch means includes a latch ring 61 and a retainer ring 62, both of which are carried in the interior of the lower section 52 of the lug expander. The latch ring in its position shown in FIG. 2 acts as a detent to retain the retainer ring in the position shown wherein it engages the detent ring 55 so that the lug expander will reciprocate with the valve actuator 32 during operation of the valve. Also as noted above engagement of the collet in groove 52*a* also latches the lug expander to the actuator 32. As will appear more fully hereinbelow, this latch ring 61 moves from the position shown in FIG. 2 into the groove 63 just above the nut 57 in the lower section 52 of the lug expander. The upper end of the nut 57 provides a side wall of the groove 63. A confronting groove 64 is provided in the exterior of the reduced diameter portion 59 of the dog prop-out. When the lug expander moves downwardly toward the shoulder 58 on the dog prop-out, the grooves 63 and 64 come into register with each other. In accordance with this invention the latch ring 61 is positioned in these two grooves by reciprocation of the lug expander to attach the dog prop-out to the lug expander and permit release of the tool from the landing nipple. To provide for the above objectives, the lower section 52 of the lug expander of the preferred form has a stepped groove therein identified generally at 65 in FIG. 3.

Any desired tools may be utilized to run and to retrieve the valve. In FIG. 1A the valve is run with pumpdown equipment and in the preferred form the valve actuator has secured thereto, as by welding to the lower end of the valve actuator adjacent the seat, a collet 66 having an internal ball receiving section 67 at its free end. The running tool indicated generally at 68 has a ball 69 at its lower end which mates with and fits within the ball shaped section 67 in the collet 66. During running of the tool the lug expander is in its up position relative to the valve actuator and the land 50 on the internal surface of the upper section 51 of the lug expander engages the exterior of the collet fingers at the ball section 67 to hold these collet fingers in depressed or contracted condition in which they engage the ball 69 of the running tool. Upon initial downward movement of the lower end 68*a* of the running tool relative to the ball 69, the lug expander is moved downwardly permitting the collet fingers to spring out into the groove 52, as shown in FIG. 1, to release the ball. The running tool 68 is conventional in form and its details are well known to those skilled in the art.

There is added to the conventional runing tool 68 a stinger 71 which is articulated in the tool 68 by the articulating ball engagement 72. The stinger 71 has an enlargement 73 on its lower end which extends into the rotating ball valve member 29 and holds the ball valve member in open position during running of the tool. The tool is thus collapsed into its shortest length. With the valve held in open position by the enlargement 73 fluid may be pumped in either direction and act upon the usual locomotive attachment to the upper end of the running tool to reciprocate the running tool and effect landing and release of the tool from the valve.

Figure 2:
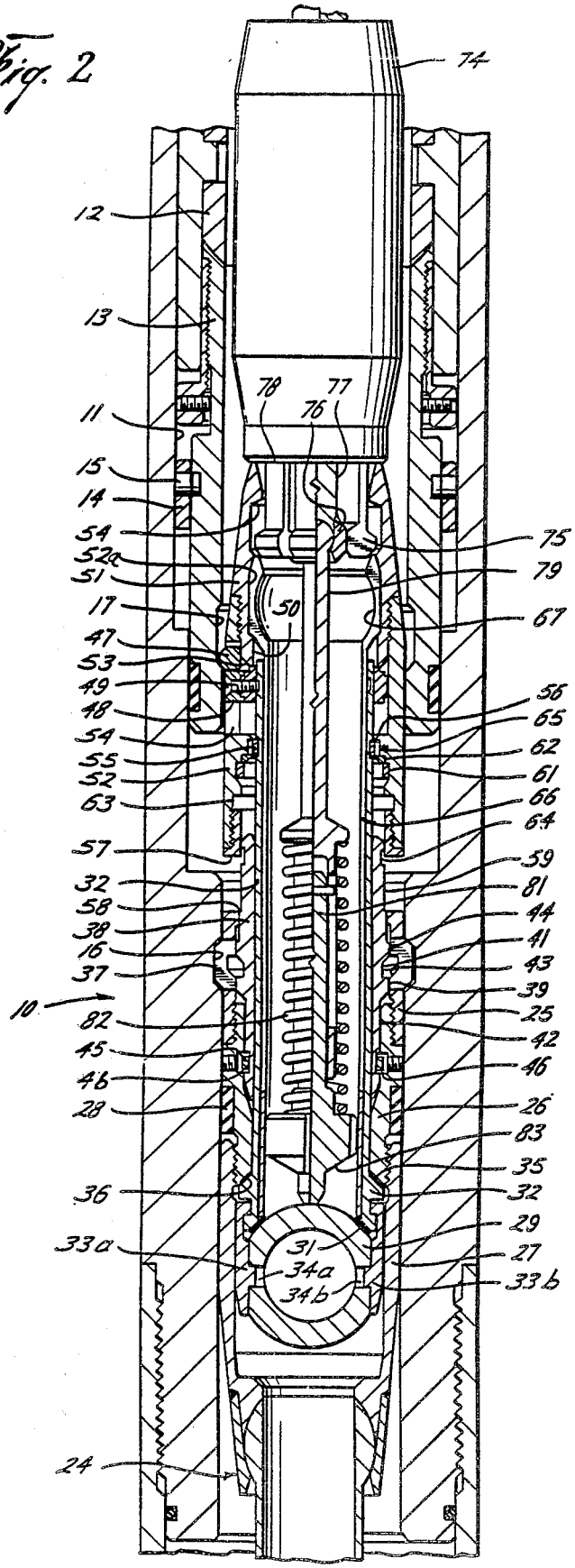
FIG. 2 is a view similar to FIG. 1 with the secondary valve shown in closed position and a pulling tool in place for removing the secondary valve.

In FIG. 2 a conventional pulling tool is shown. The tool has a plurality of fingers 75 which in the conventional manner are held expanded by the land 76 during the pulling operation. Of course, the fingers are, in the conventional manner, spring loaded in a downward direction so that they can retract into the groove 77 above the expander 76 to permit them to pass the pulling shoulder 54 and then to return to the position illustrated in which the lower surface 78 of the pulling tool will engage the upper surface of the upper section 51 of the lug expander and the pulling tool fingers 75 will engage the pulling shoulder 54 to permit the pulling tool to exert forces in both directions on the lug expander.

The pulling tool is conventional except that there is included a means for maintaining the valve member 29 in open position during pulling. This means includes an articulating stinger 79 having a telescoped extension 81 which is urged to extended position by spring 82. The extension has an enlarged section 83 on its lower end which is designed to extend into the valve member 29 and hold the valve member 29 in open position.

Normally the valve will be pulled with the valve member 9 in open position to permit full control of the pulling tool by being able to exert pressure in both directions thereon. In the event, however, that for some reason the secondary valve cannot be moved to its open position by the operator 13 using normal surface controls, the tool may still be pulled using normal pumpdown procedures. It will be noted from FIG. 2 that the valve is in its upper position when closed. Thus, when pumping down the pulling tool the pumpdown pressure will be exerted on the valve member moving it toward open position as the fluid is pumped down the well. Normal pumpdown pistons provide for bypass of fluid. For instance, a popular piston has rubber flanges which engage the tubing and provide a piston. If the locomotive is stopped fluid will bypass these rubber flanges and flow downwardly in the well. Thus, if when the pulling tool reaches the position shown in FIG. 2 the valve member 29 is closed pump pressure can be increased to force the valve member 29 toward open position and the enlargement 83 on the pulling tool will project down into the flowway through the ball valve member and lock it in open position so that thereafter the pumped fluid may exert force in both directions on the pulling tool to carry out the reciprocation needed for the release of the subsurface safety valve from the landing nipple.

With the valve actuator 32 held in its down position during running and retrieving of the valve the structure is in collapsed or its shortest length condition to facilitate traversing loops in the system.

Reference is made to FIG. 3 in which the stepped groove 65 in the lower section 52 of the lug expander may be more readily seen. The largest diameter step 84 carries the detent 55 while the tool is being run. The intermediate diameter step 85 supports the retainer ring 62. The largest diameter step 86 supports the latch ring 61. Below the largest diameter step 86 the groove has an inwardly and downwardly sloping surface 87 to force the latch ring 61 to contract.

As noted hereinabove downward movement of the lug expander 52 relative to the actuator 32 initially results in the detent 55 moving into the groove 56 to latch the lug expander to the actuator. When it is desired to pull the valve relative reciprocation between the lug expander and the actuator results in the latch ring 61 being moved into the confronting grooves 63 and 64. When this occurs the detent 55 is released and the lug expander and the dog prop-out are latched to each other so that an upward movement of the lug expander releases both lugs and dogs and permits the valve to be pulled from the well.

FIG. 3 shows the system in the running condition and shows the collet fingers 67 to be retracted and supported on the land 50. In this relationship the lug expander is in its up position as is the dog prop-out 38. When the selector landing tool 18 lands, the valve body is prevented from any further downward movement. Thus, further downward movement of the running tool against the lug expander moves the lug expander downwardly or to the right as viewed in FIG. 3 to a position in which the detent 55 drops into the groove 56 on the actuator. This relationship is shown in FIG. 4.

In FIG. 3 it will be noted that the nut 57 is against shoulder 58. Thus, when the lug expander is moved to the right as shown in FIG. 4, the dog prop-out is also moved to the right and both the dogs and lugs are moved to full extended position.

FIG. 4 shows the locked-in-operating position of the secondary valve and reciprocation of the actuator 32 opens and closes the valve member 29.

When it is desired to retrieve the valve a pulling tool such as shown in FIG. 2 is attached to the valve and an upward force exerted on the lug expander. This initial upward force is applied to the locomotive to pull the lug expander upwardly to the position shown in FIG. 5. That is, the lug expander is forced to move relative to the actuator 32 to force the collet fingers to retract and latch ring 61 to ride up the inclined surface 87 and out of the groove 86. This action results because the detent 55 remains in the groove 56 and holds the retainer ring 62 against upward movement. The retainer ring engages the latch ring 61 and forces the latch ring to retain its relationship with the detent 55. Thus, upward movement of the lug expander pulls the lug expander groove 86 out from under the latch ring 61 into the position shown in FIG. 5.

Further upward movement of the lug expander moves it to the FIG. 6 position in which the latch ring now resides in the groove 63. The latch ring at this point is in its unstressed condition and it will be noted that it partially projects inwardly out of the groove 86.

After the latch ring has been moved into the groove 63 it will engage the upwardly facing shoulder on the nut 57 which provides a part of the groove as shown in FIG. 6 and the lug expander cannot be moved up any further. This will result in an increase in pressure at the surface indicating to the operator that the lug expander is in full up position and he can reverse pressure to again move the lug expander downwardly.

As the lug expander moves downwardly it carries with it the latch ring 61 which now engages the chamferred nose 88 of the dog prop-out 38 and is expanded to permit the latch ring to pass over the end of the dog prop-out as shown in FIG. 7. Further downward movement of the lug expander moves the two grooves 63 and 64 on the lug expander and the dog prop-out, respectively, into register with each other and the latch ring contracts partially and resides in the groove 64. As the latch ring is larger in radial dimension than the depth of the groove 64, it will also reside within the groove 63 in the lug expander as shown in FIG. 8. The lug expander and the dog prop-out are now latched to each other and the lug expander cannot move any further downwardly. Again, an increase in pressure at the surface indicates to the operator that the lug expander is in full down position and he again reverses pressure conditions to place an upward pull on the lug expander which pulls the lug expander and the dog prop-out into their full up position shown in FIG. 9 in which both the lugs and the dogs are released and the valve may be pulled from the landing nipple 10 and retrieved from the well.

If for some reason it is not possible to reciprocate the operator and move the ball valve 29 to open position or to pump the valve member open, then the vale may be retrieved using wireline techniques to reciprocate the pulling tool and it will be apparent that this is possible as the recipocation of the uppermost member, that is, the lug expander, will permit the wireline tool to effect withdrawing of both the lugs and the dogs and release the tool from the landing nipple.

While it is preferred that the secondary valve be used with the primary valve shown in the above identified application it is, of course, apparent that the secondary valve can be utilized with other primary valves and may also be utilized separate from a primary valve in any situation in which it is desired to provide a valve operator which is separate from the valve. In such instance the valve operator might not be a part of the main valve, such as shown at 12 and 13, and might be a completely separate operator reciprocated in any desired manner.

While the invention has been described in conjunction with a subsurface safety valve it is apparent that the invention may be employed in any locking mandrel in which it is desired to lock the mandrel in two spaced grooves or to provide for reciprocation of one set of landing nipple grooves relative to the other set, such as herein shown as applied to a subsurface safety valve.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A subsurface safety valve comprising, a body, a valve member and seat controlling flow through the body, a valve actuator reciprocal in the body, dogs carried by the body for latching the body in a landing nipple, lugs carried by the actuator for latching the actuator to an operator reciprocal in the landing nipple, a dog prop-out for latching the dogs in extended position, a lug expander for latching the lugs in extended position, said lug expander when moving to lug extending position shifting said dog prop-out to dog extending position, detent-latch means releasably securing said actuator to said lug expander in lug expanded position for reciprocation as a unit in response to movement of said lug expander to lug expanding position and thereafter releasing said lug expander from said actuator and latching said lug expander to said dog prop-out in response to relative reciprocation of said lug expander and actuator.

2. The valve of claim 1 wherein detent means releasably holds said dog prop-out in dog extending position.

3. The valve of claims 1 or 2 wherein said lug expander has a shoulder engageable with a confronting shoulder on the dog prop-out to move the dog prop-out to dog extending position;

said detent latch means including, detent means movable into a position releasably securing said lug expander to said actuator upon initial movement of said lug expander to lug expanding position, said dog prop-out and lug expander having telescoping sections with confronting grooves movable into register with each other as the lug actuator moves toward the dog prop-out, and a latch ring movable into one of said confronting grooves upon relative movement of said lug expander and actuator in one direction after said detent means has releasably secured said lug expander to said actuator, said latch ring thereafter movable partially into said other of said confronting grooves to latch said lug expander to said dog prop-out upon relative movement of said lug expander and actuator in the other direction.

4. The valve of claims 1 or 2 wherein said lug expander has a shoulder engageable with a confronting shoulder on the dog prop-out to move the dog prop-out to dog extending position;

and said detent latch means includes, a radially outwardly facing groove in said actuator, a multi-step inwardly facing groove in said lug expander, a detent ring in the smaller diameter section of said groove movable into said outwardly facing actuator groove upon initial movement of said lug expander into lug expanding position, a retainer ring in an intermediate diameter section of said groove releasably retaining said detent ring in said small diameter groove, and a latch ring in the large diameter section of said groove releasably latching said retainer ring in said intermediate diameter section of said groove, said dog prop-out and lug expander having telescoping sections with confronting grooves movable into register with each other as the lug actuator moves toward the dog prop-out, said latch ring movable into the confronting groove of the lug expander and releasing said retainer ring upon relative movement of said lug expander and actuator in one direction after said detent ring has moved into said actuator groove, said latch ring thereafter movable partially into said dog prop-out groove to latch said lug expander to said dog prop-out upon relative movement of said lug expander and actuator in the other direction.

5. The valve of claims 1, 2, 3 or 4 wherein a collet is carried by said actuator, said lug expander has a land cooperable with said collet to initially contract said collet with said lug expander spaced from lug expanding position and a groove cooperable with said collet to permit said collet to expand upon movement of said lug expander relative to said actuator to lug expanding position provide a part of the detent-latch means for latching the lug expander to the actuator, and a pulling shoulder in said lug expander.

6. The valve of claim 5 in combination with a pulling tool having lugs engageable with said pulling shoulder and a prong extending into said valve body, said prong including two telescoping parts collapsible upon engagement of said prong with said valve member when in closed position and extensible to prop the valve member in open position upon movement of said valve member to open position, and resilient means urging said telescoping parts toward extended position.

7. The subsurface safety valve of claims 1, 2, 3, 4, 5 or 6 wherein the valve member is in closed position when the actuator is in its up position so that tubing pressure above the valve and effective upon the valve member will move the valve to open position.

8. A locking mandrel comprising, a body, an actuator reciprocal in the body, dogs carried by the body for latching the body in a landing nipple, lugs carried by the actuator for latching the actuator to an operator reciprocal in the landing nipple, a dog prop-out for latching the dogs in extended position, a lug expander for latching the lugs in extended position, said lug expander when moving to lug extending position shifting said dog prop-out to dog extending position, detent-latch means releasably securing said actuator to said lug expander in lug expanded position for reciprocation as a unit in response to movement of said lug expander to lug expanding position and thereafter releasing said lug expander from said actuator and latching said lug expander to said dog prop-out in response to relative reciprocation of said lug expander and actuator.

* * * * *